United States Patent [19]

Andersson

[11] Patent Number: 4,703,606

[45] Date of Patent: Nov. 3, 1987

[54] MACHINE FOR FILLING CONTAINERS WITH SINGLE-PIECE GOODS

[75] Inventor: Kjell Andersson, Loddekopinge, Sweden

[73] Assignee: Tetra Pak International Aktiebolag, Lund, Sweden

[21] Appl. No.: 884,899

[22] Filed: Jul. 14, 1986

Related U.S. Application Data

[63] Continuation of Ser. No. 679,209, Dec. 7, 1984, abandoned.

[30] Foreign Application Priority Data

Dec. 14, 1983 [SE] Sweden ..... 8306912

[51] Int. Cl.[4] ..... B65B 5/00

[52] U.S. Cl. ..... 53/247; 53/249; 53/251

[58] Field of Search ..... 53/147, 247-251, 53/260, 282, 535, 539, 543

[56] References Cited

U.S. PATENT DOCUMENTS

| | | | |
|---|---|---|---|
| 3,307,328 | 3/1967 | Rowekamp | 53/247 |
| 3,826,382 | 7/1974 | Zappia | 53/247 X |
| 3,948,018 | 4/1976 | Rowekamp | 53/247 X |
| 4,406,110 | 9/1983 | McGill | 53/249 |
| 4,506,493 | 3/1985 | Horton | 53/251 X |
| 4,534,157 | 8/1985 | McGill et al. | 53/249 X |

FOREIGN PATENT DOCUMENTS

| | | | |
|---|---|---|---|
| 293345 | 11/1962 | Netherlands | 53/539 |
| 707067 | 4/1954 | United Kingdom | 53/539 |

*Primary Examiner*—Robert L. Spruill
*Assistant Examiner*—Steven P. Weihrouch
*Attorney, Agent, or Firm*—Cyrus S. Hapgood

[57] ABSTRACT

A conveyor moves empty containers for single-piece goods one-by-one below an openable bottom on which successive accumulations of the goods are supported. A device for holding an empty container is raised by a control system from a lower position adjacent the conveyor to an upper position below said bottom, the control system being operable to impart to said device with a container thereon a dampened and continuous downward movement from its upper to its lower position in response to falling of a said accumulation against the container when said bottom is opened. The control system includes a valve having a first position for supplying compressed air to one side of a plunger-cylinder assembly to raise said device, a second position for supplying compressed air to the other side of said assembly to hold said device in its upper position, and a third position for venting said one side of said assembly to effect said continuous downward movement.

14 Claims, 2 Drawing Figures

MACHINE FOR FILLING CONTAINERS WITH SINGLE-PIECE GOODS

This application is a continuation of my copending application Ser. No. 679,209 filed Dec. 7, 1984 now abandoned.

The present invention relates to an improvement in a machine for filling containers with single-piece goods, said machine having means for accumulating goods on an openable bottom at a level above a conveyor carrying a succession of empty containers to a region underneath said bottom, means being provided for opening the bottom in order to deposit the accumulated goods quantity in the underlying container.

BACKGROUND OF THE INVENTION

Prior art container filling machines of the type depositing from a height single-piece goods into a container on an underlying conveyor suffer from the disadvantage that the goods strike the container bottom unyieldingly carried on the conveyor with too great a force and frequently in a disorderly manner deviating from the orientation in which they are dropped, thus causing damage to the goods.

It is the principal object of this invention essentially to reduce this problem encountered in prior art machines of the type here referred to.

SUMMARY OF THE INVENTION

To this end, the machine according to the invention is provided with a device movable from a lower to an upper position to raise the empty container from the conveyor into alignment with the, as yet, closed bottom directly beneath said bottom, and a control system connected to said device for imparting thereto a dampened and continuous downward movement from said upper to said lower position in response to falling of an accumulation of goods against the container.

In this manner, the impact of the goods on the container bottom will have the effect that the container takes over part of the kinetic energy of the deposited goods in a prolonged descending motion, so that the energy of the impact of the goods on the container bottom is absorbed successively, and the risk of damage to the goods is reduced.

DESCRIPTION OF THE PREFERRED EMBODIMENT

Figure 1:
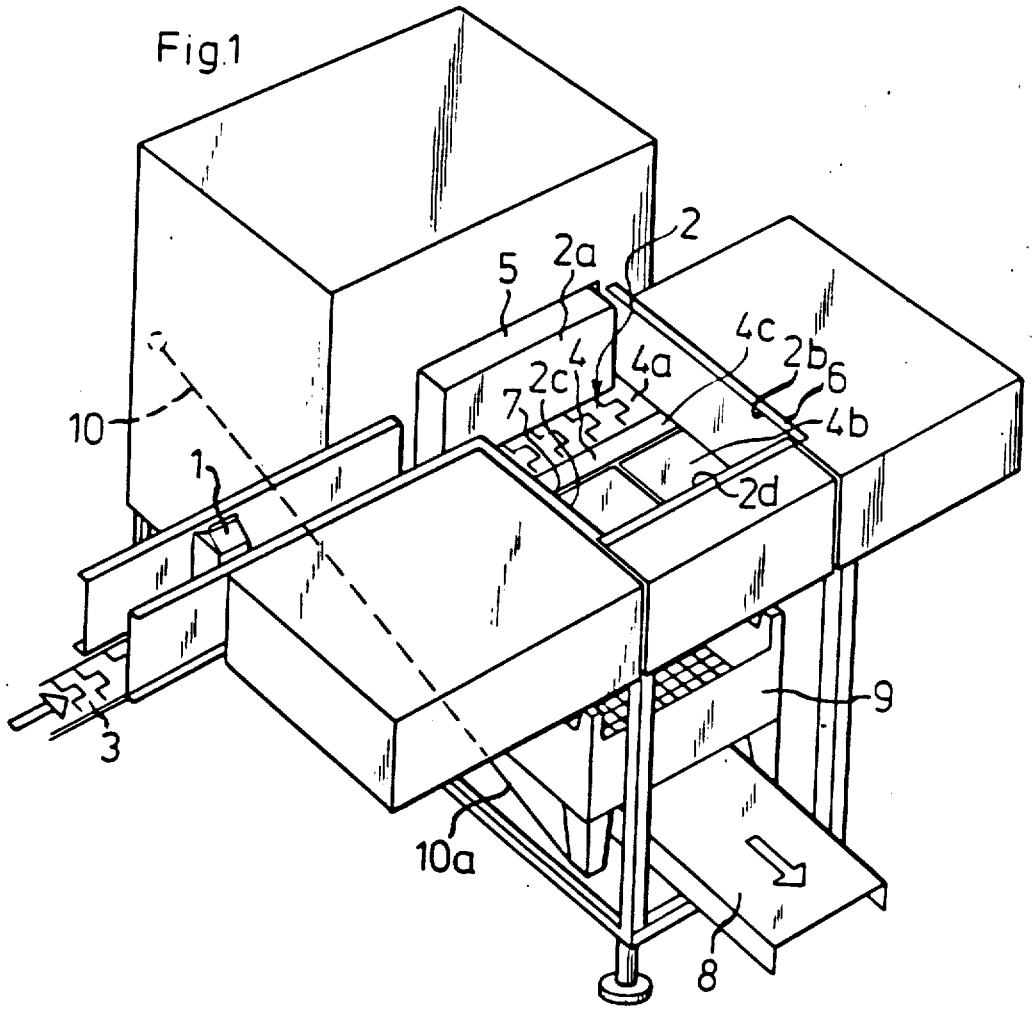
Figure 2:
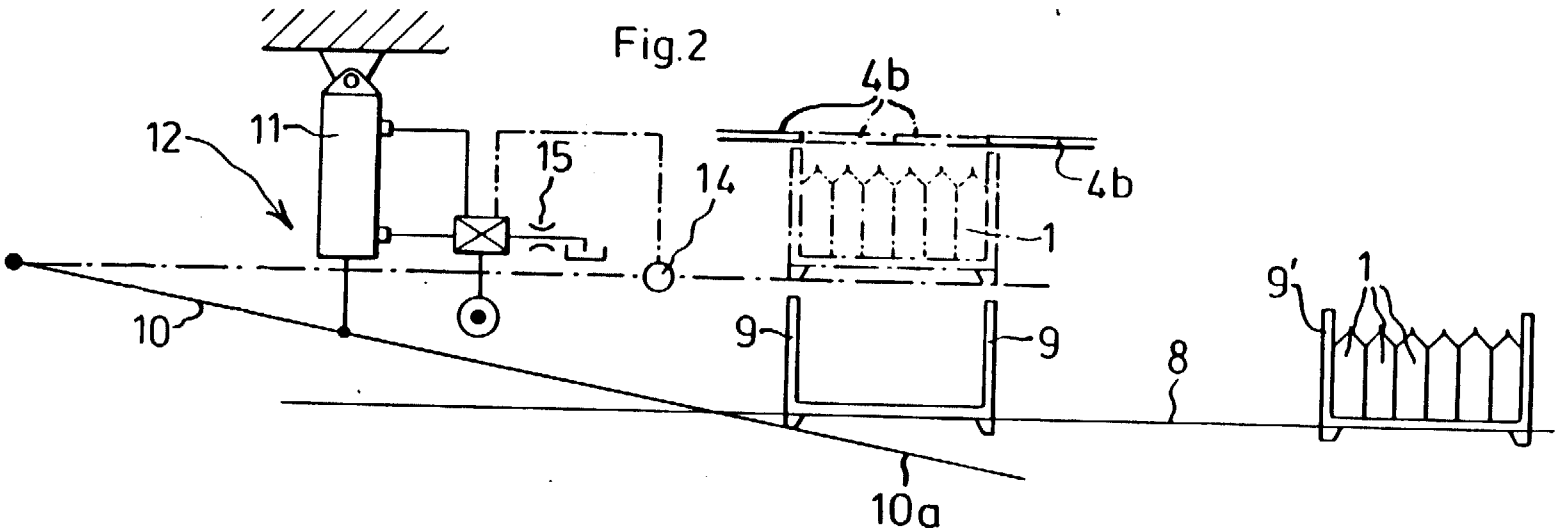

The invention will be described below in more detail, reference being had to the accompanying drawings in which FIG. 1 is a perspective view of a conventional container filling machine, showing details of the invention; and FIG. 2 is a schematic view of an embodiment of the invention.

FIG. 1 illustrates a container filling machine of conventional construction, except that it is provided with means according to the invention which will be described in connection with FIG. 2. In this conventional machine, the function and basic construction of which will now be described, identical single-piece goods 1, such as rectangular packages, are carried in spaced apart relationship to a rectangular collecting space 2 having lateral boundary walls 2*a*, 2*b*, 2*c*, 2*d*, by means of an endless conveyor belt 3, a section 4*a* of which constantly forms an end zone of the horizontal bottom 4 of the space 2. The bottom end zone is located adjacent a plunger 5, the end face of which forms the side wall 2*a* of the space 2, said plunger being guided in such a manner that, when the goods have come to a stop against the space wall 2*b* and filled the said conveyor belt section or bottom zone 4*a*, i.e. when a row of a predetermined number of interabutting goods has been formed in this zone, the plunger is activated to make a forward stroke slightly longer than the width or transverse dimension of the belt section or bottom zone 4*a*, such that the row of goods is pushed out of this zone towards the opposite wall 2*d* of the space. At the same time, any preceding rows of goods on the bottom 4 are pushed towards the opposite wall 2d through the same distance. Beyond the bottom zone 4*a*, the bottom 4 is defined by a trapdoor 4*b* divided in its center into two halves which can be horizontally pulled apart for opening. The area of the trapdoor or bottom zone 4*b* is so chosen that this zone can be filled with a predetermined number of densely packed rows of goods. The trapdoor or bottom zone 4*b* can border upon the said belt section or bottom zone 4*a* or, as will appear from the drawing, may be separated therefrom by means of a stationary bottom zone 4*c* for intermediate storage of rows of goods. When the last row of goods, i.e. the row of goods which is to completely fill the trapdoor 4*b*, has been formed on the bottom zone 4*a*, the plunger 5 is activated to push this row forward with an excess stroke paying regard to the dimension of the intermediate storage zone 4*c*, if any, in the direction of movement, the excess stroke being sufficient to cause the plunger 5 positively to clamp the rows of goods collected on the trapdoor or bottom zone 4*b* between itself and the opposite wall 2*d* of the space. The boundary walls 2*b*, 2*c* of the space 2 preferably also constitute the front face of plungers 6, 7 movable in the normal direction of these walls and adapted, simultaneously with said clamping of the rows of goods between the plunger face 2*a* and the wall 2*d* to positively clamp these rows on their two other sides or ends.

In this manner, the rows of goods on the trapdoor 4*b* can be positively retained and held together on all sides during the time the trapdoor is being opened, and the goods standing on the trapdoor thus can be deposited therethrough as a unit, i.e. all goods at the same time, only when the trapdoor 4*b* is fully open.

The above-mentioned forward strokes of the plungers 5, 6, 7 are activated by a photocell and time delay system which on the one hand senses when a finished row of goods has accumulated on the section or bottom zone 4*a* of the conveyor 3 and activates the forward stroke of the plunger 5 and, on the other hand, senses when the last row of goods is in position on the trapdoor or bottom zone 4*b* and activates the said clamping-together of the rows of goods and then opening of the trapdoor, whereupon the return strokes of the plungers 5, 6, 7 and closing of the trapdoor are activated. To this end, the plungers 5, 6, 7 may be, for example, the plungers of double-acting compressed air cylinders. Opening and closing of the trapdoor may also be effected by compressed air for horizontally pulling apart the door halves.

Below the collecting space 2, a container conveyor 8 travels and conveys spaced apart empty containers 9 successively into alignment with the trapdoor 4*b*. After the empty containers have been filled with the rows of goods on the trapdoor 4*b*, the conveyor 8 carries and conveys containers 9' filled with rows of goods. The conveyor movement is controlled in such a manner, for example by means of a photocell means included in the above-mentioned photocell system, that the conveyor stops when an empty container 9 is directly below the trapdoor or bottom zone 4*b*. In an alternative arrangement, the conveyor 8 need not be stopped, and the empty container as well as the container queue behind it can be brought to a standstill on the traveling conveyor by stop means activated by the photocell which acknowledges the arrival of an empty container in the area below the trapdoor. The goods-receiving part of the containers has a horizontal cross-sectional area which is slightly larger than the area of the trapdoor and is congruent with the opening of the trapdoor so that, when the trapdoor has been fully opened and the plungers 5, 6, 7 are retracted., the rows of goods are dropped down into and fill out the underlying container part which at that moment has been brought to a standstill. The containers are carried on the conveyor 8 with their lower bottom side protruding a distance beyond the side edges of the conveyor 8 on either side of the conveyor. On these sides the containers may be provided with legs or with the descending walls provided with windows. Continued movement of the conveyor 8 is activated after the rows of goods descending through the trapdoor have struck the bottom of the empty container 9.

To avoid the disadvantage referred to in the introduction of the specification and encountered in container filling machines of this construction, the machine according to the invention has a control system for operating a device which first raises the empty container standing directly under the trapdoor from the container conveyor 8 and then, in a continuous downward movement, gradually absorbs the kinetic energy of the row of goods falling through the trapdoor.

This device comprises, in the embodiment now described, an arm 10 hingedly attached at one end on the machine frame for vertical pivotment between a lower position and an upper position substantially beneath the trapdoor. The arm 10 is fork-shaped at its other end portion, and the two fork arms 10a extend in parallel with the container conveyor 8 on either side thereof, their mutual distance being such that they extend in under the container legs or descending walls on either side of the conveyor 8 when the arm is in its lower position, as is the case during movement of the container conveyor and at the time when an empty container is at standstill in an area underneath the trapdoor 4*b*. The forks 10*a* have inner side flanges and thus are L-shaped in cross-section to laterally guide and hold a container conveyed thereover, i.e. in parallel with the container conveyor 8.

On its upper side, the arm 10 is hingedly connected to an actuator shown as the plunger of a compressed air cylinder assembly 11 which lies outside the area of the trapdoor 4*b* and is hingedly connected to the machine frame at its other higher end. The cylinder-plunger actuator is part of a control system 12 for lifting and lowering the arm device 10. After the movement of an empty container 9 has been stopped in the manner mentioned above when the empty container has arrived in an area beneath the trapdoor 4*b*, control system 12 acts through arm 10 to lift the empty container 9 from the conveyor 8 into an upper goods-receiving position aligned with the opening of the trapdoor 4*b*. The lifting stroke of the plunger of the assembly 11 is so dimensioned that, when it has raised the arm 10 carrying an empty container 9 into its upper position, the fork end of the arm is horizontal so that the forks 10*a* positively support the empty container, which also is in its upper position in which it is supported by all of its legs.

The control system 12 also acts through arm device 10 to lower a filled container from its upper position down onto the conveyor 8. The cylinder 11 may therefore be of the single-acting type operated by compressed air via a three-position valve 13 for upward movement of its plunger into a predetermined end position corresponding to the upper positions of the arm 10 and the empty container 9. This upper end position of the plunger may be determined by a sensing device such as a photocell 14 for sensing the upper position of the arm 10 and activating the valve 13 to exert a load on the other side of the plunger with a lower counterpressure. The pressure differential is so dimensioned that it essentially balances the combined weights of the lifting arm and the empty container. When the arm with the empty container are in the upper positions, they may both be described as being essentially floatingly suspended.

The pressure side of the cylinder 11 is automatically vented when the bottom of the floating empty container 9 is struck by the goods falling through the opened trapdoor 4*b* in the manner described above. On impact, the goods quantity transfers part of its kinetic energy to the arm and the empty container, which transfer may also be detected by the photocell means 14. For example, the latter may react to the initial downward movement of arm 10 from its upper position, said reaction being used for setting the valve 13 to vent the cylinder 11 on the pressure side (lower side). The venting line comprises a throttle 15 which can be set to give the desired velocity for lowering the arm 10 and the filled container 9′ carried thereby. The arm thus can gently deposit the filled container on the conveyor 8. The signal for lifting an empty container by means of the arm can be derived, in the embodiment described, from the signal which stops the conveyor 8 when an empty container 9 has arrived in the area beneath the trapdoor 4*b*. In the embodiment illustrated, the position in which an empty container arriving in the area beneath the trapdoor is detected, is selected with regard to the circular arc movement of the arm during lifting of a container so that the empty container in the upper position will be aligned with the trapdoor, as has been mentioned before.

Naturally, many other per se known means for lifting, lowering and dampening may be used in the context of this invention, also entirely mechanical arrangements with springs lifting and lowering the container in the vertical direction instead of in the path of a circular arc.

As will be apparent from the foregoing, the arm 10–10*a* constitutes a device having a lower position adjacent a container 9 located on conveyor 8 and underlying the openable bottom 4*b*, the device 10–10*a* being movable to an upper position to lift the empty container from conveyor 8 to an upper position directly beneath said bottom 4*b*. The control system 12 includes parts 11, 13–14 and is operable in one position of its control means (valve 13) to operate actuator 11 so as to raise arm 10 and container 9. In response to these rising parts reaching their upper positions, the control system acts through its sensing device 14 to shift control means 13 to a second position where it causes actuator 11 to hold arm 10 and container 9 in their upper positions by opposing forces. Of these forces, the upwardly directed holding force is yieldable downward (by the previously mentioned venting through throttle 15 as shown) to accommodate movement of arm device 10 from its upper to its lower position.

In response to opening of trapdoor 4b so that the falling goods impact against raised container 9, control system 12 acts through its sensing device 14 to shift control means 13 to a third position to initiate downward yielding of said upwardly directed holding force. In this way the impact causes the control system to impart to arm 10 a dampened and continuous downward movement to its lower position at a velocity which can be controlled by regulating the rate of said downward yielding.

I claim:

1. In combination with a machine for filling containers with a single-piece goods and including an accumulating station having an openable bottom, means for providing an accumulation of the goods on said bottom while it is closed, and a conveyor for carrying a succession of empty containers to a region below said bottom, the improvement comprising means for opening said bottom to allow said accumulation of goods to fall against an underlying empty container, a movable device having a lower position adjacent said underlying empty container and movable to an upper position to lift said empty container from the conveyor to an upper position for receiving said accumulation of goods upon opening of said bottom, and a control system connected to said device for imparting thereto a dampened and continuous downward movement from its said upper to its said lower position, said system including means operable by downward impact of said accumulation against said container to initiate said continuous downward movement simultaneously with said impact.

2. The combination of claim 1, comprising also means for adjusting the control system vary the velocity of said continuous downward movement.

3. The combination of claim 1, which the control system also includes an actuator connected to said movable device, and control means connected to the actuator and having a first position for operating the actuator to raise said device from its lower to its upper position, the control means having a second position for operating the actuator to hold said device in its said upper position, said control means having a third position for operating the actuator to impart said downward movement to said device.

4. The combination of claim 3, in which the control system also includes a sensing device for shifting said control means from its first to its second position in response to raising of said movable device to its upper position.

5. The combination of claim 4, in which said sensing device is operable to shift said control means from its second to its third position in response to and simultaneously with said impact.

6. The combination of claim 3, in which the control system also includes a sensing device for shifting said control means from its second to its third position in response to and simultaneously with said impact.

7. The combination of claim 3, in which said actuator is a plunger-cyclinder assembly, the control system also including a compressed air source, said control means being operable in its first position to connect said source to one side of the plunger of said assembly to raise said device, said control means being operable in its second position to connect said source to both sides of said plunger to hold said device in its said upper position, said control means being operable in its third position to vent one side of the plunger and thereby impart said downward movement.

8. The combination of claim 7, in which the control system also includes a sensing device for shifting said control means from its first to its second position in response to raising of said movable device to its upper position.

9. The combination of claim 8, in which said sensing device is operable to shift said control means from its second to its third position in response to and simultaneously with said impact.

10. The combination of claim 9, in which said control means is a three-position valve.

11. The combination of claim 7, in which the control system also includes a sensing device for shifting said control means from its second to its third position in response to and simultaneously with said impact.

12. The combination of claim 1, in which the control system also includes means for holding said device in its upper position by opposing forces of which the upwardly directed holding force is adapted for downward yielding to accommodate movement of said device from its upper to its lower position.

13. The combination of claim 12, in which said initiating means includes a sensing device for initiating said downward yielding.

14. The combination of claim 1, in which said initiating means includes a photocell positioned to sense said impact.

* * * * *

UNITED STATES PATENT OFFICE
CERTIFICATE OF CORRECTION

PATENT NO. : 4,703,606

DATED : November 3, 1987

INVENTOR(S) : Kjell Andersson

It is certified that error appears in the above-identified patent and that said Letters Patent are hereby corrected as shown below:

Column 5, claim 2, line 2, after "system" insert--to--.

Signed and Sealed this

Seventh Day of June, 1988

*Attest:*

*Attesting Officer*

DONALD J. QUIGG

*Commissioner of Patents and Trademarks*